United States Patent [19]

Gallet et al.

[11] Patent Number: 4,911,464

[45] Date of Patent: Mar. 27, 1990

[54] MOVABLE AND RECENTERABLE ANTI-FRICTION PLATE FOR USE WITH A SAFETY BINDING

[75] Inventors: Yvon Gallet, Annecy; J. Pierre Dimier, Rumilly, both of France

[73] Assignee: Salomon S.A., Annecy Cedex, France

[21] Appl. No.: 80,105

[22] Filed: Jul. 31, 1987

[30] Foreign Application Priority Data

Aug. 5, 1986 [FR] France ..... 8611967

[51] Int. Cl.[4] ..... A63C 9/081; A63C 9/085

[52] U.S. Cl. ..... 280/636; 280/625; 280/629

[58] Field of Search ..... 280/618, 620, 625, 626, 280/629, 634, 636

[56] References Cited

U.S. PATENT DOCUMENTS

| | | | |
|---|---|---|---|
| 3,037,785 | 6/1962 | De Place | 280/629 |
| 3,079,163 | 2/1963 | De Beausacq | 280/616 |
| 3,743,308 | 7/1973 | Allsop | 280/634 |
| 3,893,685 | 7/1975 | Svoboda | 280/634 |
| 4,336,956 | 6/1982 | Richert et al. | 280/625 |
| 4,479,664 | 10/1984 | Gertsch | 280/625 |
| 4,516,792 | 5/1985 | Scheck et al. | 280/634 |

FOREIGN PATENT DOCUMENTS

| | | |
|---|---|---|
| 2092844 | 1/1972 | France . |
| 2173049 | 10/1973 | France . |
| 2366851 | 5/1978 | France . |
| 2560778 | 9/1985 | France . |
| 0490871 | 7/1970 | Switzerland . |
| 8503451 | 8/1985 | World Int. Prop. O. . |

*Primary Examiner*—Charles A. Marmor
*Assistant Examiner*—Brian Johnson
*Attorney, Agent, or Firm*—Sandler & Greenblum

[57] ABSTRACT

A safety binding comprises a fixed body and two independent wings which are laterally pivotable on a stationary member. An anti-friction plate can be pivotably mounted around a fixed axis and comprises two openings which respectively receive two arms which are affixed to two independently movable wings. The abutments or arms limit the extent of movement of the anti-friction plate, and insure its automatic recentering.

41 Claims, 3 Drawing Sheets

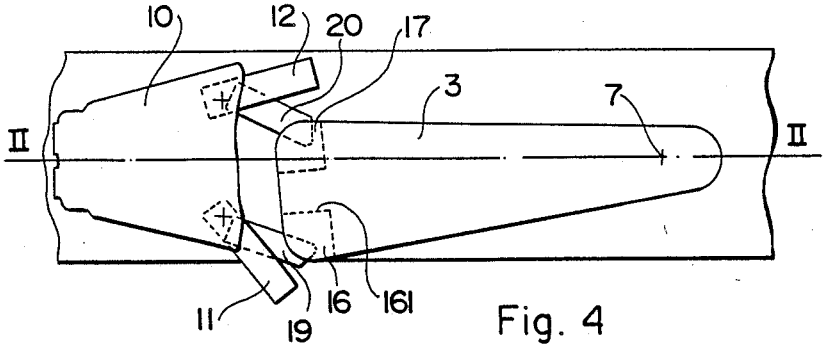
Fig. 4
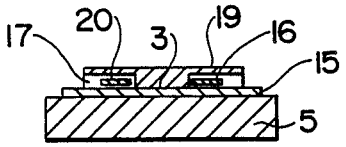
Fig. 5
Fig. 6
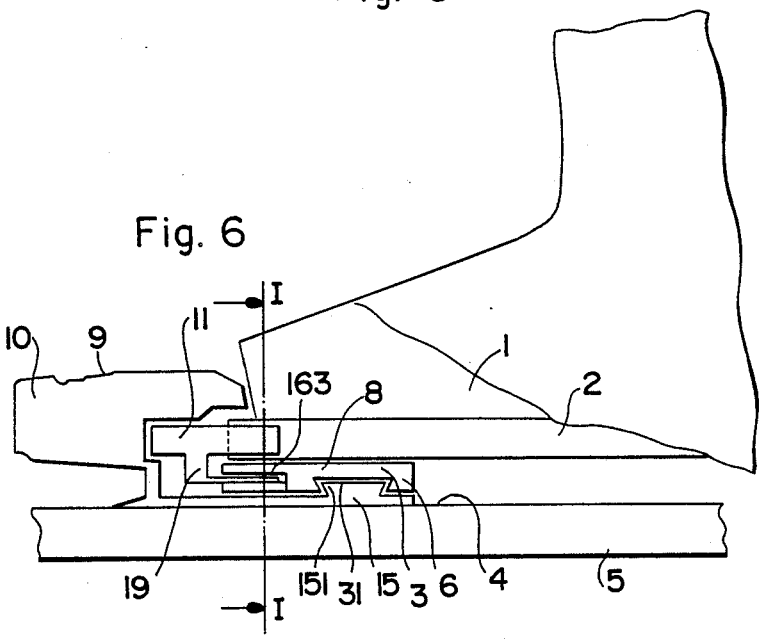

MOVABLE AND RECENTERABLE ANTI-FRICTION PLATE FOR USE WITH A SAFETY BINDING

BACKGROUND oF THE INVENTION

1. Field of the Invention

The present invention generally relates to a safety binding assembly, including a movable boot supporting plate, for use with skis which is adapted to maintain, in a laterally releasable fashion, one of the ends of a boot with respect to a ski; and, more specifically, to a safety binding for a ski which is adapted to retain either the front of the boot, or the rear, but which is however more particularly adapted to retain the front. The binding is further adapted to facilitate freeing a ski boot from a ski by lateral displacement when a force is exerted on the binding by the boot.

2. Description of Background Materials and Relevant Information

A safety binding such as that described herein assures the safety of a skier by responding, through its lateral release, to excessive torsional forces at the level of the leg of the skier. Presently available safety bindings employing a lateral release mechanism have a certain number of disadvantages, particularly when a torsional fall of the skier is combined with a frontward fall. For example, when movement occurs that causes the weight of the skier to move forwardly, the bottom of the sole of the boot of the skier is pressed against the ski with a substantial force directed downwardly towards the ski. This serves to create, between the bottom of the sole and the support surface therefore, a substantial frictional force opposing the lateral displacement of the boot; conventional lateral release safety bindings have exhibited difficulty in overcoming such frictional force.

A solution has long been sought to the problem of safety bindings of the lateral release type in order to provide a binding which maintains the boot substantially immobile so as to permit normal skiing in a stable maintenance position of the boot, substantially along the vertical longitudinal median plane of the binding; yet which is surely laterally releasable, as necessary, by reducing to a minimum the friction between the sole of the boot and the upper surface of the ski.

It has thus been previously proposed to glue to the surface of the ski a plate made of an anti-friction material, such as is described in French Patent No. 2,092,844. However, the cleats which may be provided under the sole of a ski boot act to considerably increase the friction that exists between the sole of the ski boot and the top of the ski, and often render the separation of the two uncontrollable.

To further diminish friction between the boot sole and the ski, it has been proposed to insert between the sole of the boot and the upper surface of the ski a movable support plate which is adapted to be laterally displaced with the boot. In such a system, sliding between the movable plate and the ski should not be hindered by excessive friction or by the cleats of the boot.

One solution, described in Document W085/03,451, consists of utilizing plates affixed to the binding. However, in this first case, if ice forms between the plate and the ski, the binding will be blocked, or at least a very substantial disturbance to its continued operation will occur.

A second solution, described in Swiss Patent No. 490,871, consists of providing a rotatable plate, positioned on the upper surface of the ski, which is biased so as to return to a central position; this action is actuated by a recentering spring. The disadvantage of this second solution is that during release of the binding, the boot pivots the plate against the energy of its recentering spring. This energy adds to the energy of the binding, and increases the force which the leg must exert to result in the release of the binding.

SUMMARY OF THE INVENTION

The present invention has as one particular object to provide a safety binding having an anti-friction plate which, following its release, automatically recenters. The operation of recentering the anti-friction plate does not affect the release or other operation of the binding, nor further movement of the boot. Braking or possible blockage of the anti-friction plate by ice will thus not occur herein, thereby avoiding hindrance of the normal mechanism of the binding.

According to another object of the invention, the return of the anti-friction plate is assured by the binding itself, such that it does not require any supplemental return structure.

In another aspect, the present invention provides a safety binding assembly adapted to be attached to a ski in order to releasably retain a boot on said ski. The binding assembly comprises an anti-friction plate adapted to be laterally movably attached to an upper surface of said ski, said anti-friction plate comprising means for supporting the sole of said boot when said boot is positioned on said ski; and a binding having a fixed body adapted to be attached to said ski adjacent one end of said plate. The fixed body includes first and second independently movable wings attached thereto, with the wings comprising means for laterally retaining one end of the boot adjacent said one plate end. Each of the wings is biased into a predetermined stable boot maintenance position by elastic return means, wherein said boot is adapted to be positioned along a substantially longitudinal vertical median plane of said ski binding when said wings are in said stable maintenance position. The assembly also includes means for guiding free lateral movement of said anti-friction plate. Each of the first and second movable wings further comprises means for limiting lateral movement of the anti-friction plate by controlling movement of first and second stops which are adapted to engage such a plate.

The first and second movable wings are attached to respective stops and thereby comprise means for moving said stops into a plurality of positions for limiting lateral movement of said plate. The elastic return means comprise means for biasing said wings towards the median vertical plane of the ski, and thereby comprise means for centering said anti-friction plate in said stable boot maintenance position. The first and second stops comprise means for maintaining said plate, when supporting the boot in said stable maintenance position, such that said plate is adapted to have only limited movement on either side of said median plane.

The stops comprise first and second movement limiting members, each stop having one end attached to a respective one of said wings and a second end comprising an abutment against which a central portion of said anti-friction plate is adapted to abut. Each of the wings is integrally attached to respective ones of said stops, wherein movement of one of said wings causes an equal displacement of the stop which is attached to said wing in a direction towards and away from said longitudinal vertical median plane. The stops are positioned on opposite sides of the central plane of said anti-friction plate.

Each of the wings is pivotable over a predetermined maximum displacement, with respective stops being pivotable with said wings and thereby comprising means for variably defining the limit of the lateral extent of movement of said anti-friction plate away from said median plane.

The anti-friction plate includes first and second recesses on a lower surface of said anti-friction plate, with respective stops being adapted to be positioned in respective recesses of said plate; and the anti-friction plate is adapted to be freely and pivotably mounted about a substantially vertical axis with respect to said ski. The binding body includes a track comprising means for guiding lateral movement of said plate, with the plate having a lower surface with a continuous groove for receiving said track.

In a further aspect, the present invention provides a safety ski assembly adapted to be attached to a ski. The assembly comprises a movable plate adapted to be attached to the upper surface of a ski, said plate having first and second ends; a binding adapted to be attached to the upper surface of a ski, said binding having two movable wings attached thereto and means for biasing the wings into a stable position; and means for limiting the extent of lateral movement of said plate, said extent limiting means being controlled by, and attached to, said movable wings.

A first end of the movable plate is pivotably mounted to said ski about a fixed vertical axis. The movable plate provides a movable support surface which is adapted to move a ski boot when a boot is positioned on the plate; and one end of said movable plate is positioned over said binding, with said one plate end being laterally movable between said extent limiting means.

The movable plate has an upper surface and an underside, with a groove located on said underside. The groove is positioned substantially transverse to the extent of said plate; and the binding includes an upwardly directed rib comprising a track on which said groove is slidably positioned. The rib and groove can be arcuate or can be substantially linear.

The extent of said lateral plate movement is limited along both sides of the median plane of symmetry of the ski. One end of the movable plate comprises two lateral recesses on an underside of said plate, with the recesses being separated by a central tongue; and the extent limiting mean comprise stop arms attached to said movable wings, said stop arms being adapted to fit within said plate recesses and abut said plate tongue to limit movement of said plate.

The binding comprises a fixed body which includes a base and said two laterally movable wings. The stationary base extends in the direction of the longitudinal axis of said ski when the binding is attached to the upper surface of said ski, with the base comprising a platform on which the movable plate rests when the plate is stably maintained along a median longitudinal plane of said ski; and the wings are independently pivoted to said binding body. One end of each of the movable wings is pivotably connected to said binding. The independently movable wings are biased into a stable position in which one end of a ski boot adapted to be positioned on said plate is maintained in a stable position by said extent limiting means. The extent limiting means comprises arms, said stable boot position occurring when said arms abut one end of said plate when said plate is positioned in said stable maintenance position. The movable wings are biased by elastic return means to automatically return said wings to said stable wing position. Each of the wings can be biased into a stable position by elastic return means. The wings are adapted to be displaced from the stable position by application of a predetermined force exerted by said ski boot. The extent limiting means comprise stop arms, each of said arms being attached to one of said movable wings. Each of said stop arms is integrally connected to one movable wing, wherein each wing and its connected arm are pivoted simultaneously when one end of said boot moves laterally, abuts a wing and moves the abutted wing outwardly from said ski. Elastic return means are provided which comprise means for returning said wings to a stable wing position when said wings have moved outwardly away from said ski.

The biasing means comprise means for biasing the wings into a stable position when the wings have moved outwardly from the ski; and the plate and binding can be mounted on a ski.

BRIEF DESCRIPTION OF DRAWINGS

The above and other objects, characteristics and advantages of the present invention will now be more fully described with reference to the annexed drawings, given by way of non-limiting examples only, in which like reference numerals represent similar parts throughout, and wherein:

FIG. 4 is a view similar to FIG. 3 in which the anti-friction plate is in the extreme lateral position;

FIG. 5 is a transverse cross-sectional view taken along plane I—I of FIG. 1;

FIG. 6 schematically illustrates a side view of a binding formed according to an alternative embodiment of the present invention.

DESCRIPTION OF PREFERRED EMBODIMENTS

Figure 1:
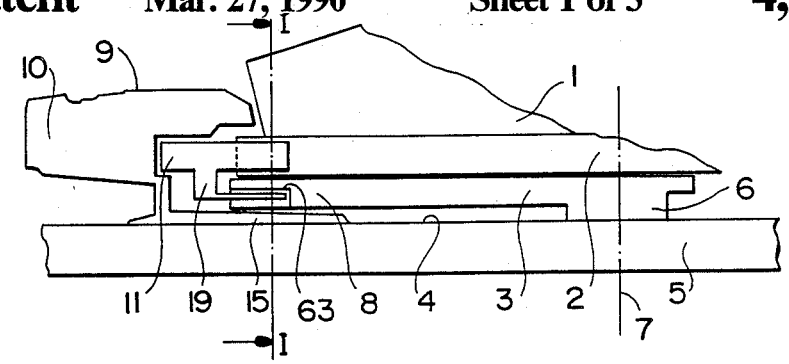
FIG. 1 schematically illustrates a binding formed according to the present invention, in side view.

One object of the present invention is to overcome all of the above-noted disadvantages and to provide a safety binding for use with a ski in which a fixed body is provided with first and second laterally and movable independent wings adapted to laterally retain one end of the boot, the wings being biased by elastic return means towards a stable maintenance position in which the boot is positioned along the longitudinal vertical median plane of the binding. The bindings have independently movable wings which can be displaced individually, in a generally symmetrical fashion with respect to the plane of symmetry of the ski, such that one wing can move without causing movement of the other. In particular, it is not necessary that each wing be positioned symmetrically about the median vertical plane of symmetry of the ski with the plate in its stable equilibrium position. In other words, movement of one wing with respect to the longitudinal plane of symmetry of the ski creates, on the other wing, a spacing which is either zero or opposite with respect to the plane of symmetry.

To achieve these objects as well as others, the anti-friction plate is guided by vertical and longitudinal guiding means which allow for free lateral movement of the boot; the free lateral extent of movement of the anti-friction plate is limited on both sides by first and second extent limitors, e.g., stops (arms), respectively defining first and second extreme lateral positions over which the anti-friction plate can move. The first and second extent limitors are, respectively, controlled by (and, in fact, attached to) first and second binding wings such that each extreme position of the movable anti-friction plate has, with respect to the vertical median longitudinal plane of the binding, a spacing from the plane which is a function of the spacing of the corresponding lateral wing with respect to this plane. In this way, opening movement of the wings towards the exterior of the ski frees the anti-friction plate without moving it, such that if the anti-friction plate is blocked or braked by ice, the binding itself is not braked. The boot can thus move the anti-friction plate laterally without having to overcome the force of the elastic return means, and the return of the wings towards their stable, central boot maintenance position tends to recenter the anti-friction plate; when centered, the apparatus limits movement of the plate (i.e., when the plate is in its stable maintenance position).

According to one embodiment, the extent limitors comprise first and second returns or stops, respectively, affixed to the first and second binding wings.

The spacing of one wing causes the spacing of the corresponding stop; in similar fashion, the movement of one wing back to the median plane of symmetry of the ski causes the same movement of the corresponding stop.

In the stable maintenance position of the boot, the end portions of the stops preferably constitute two abutments between which a central portion of the anti-friction plate is engaged. As such, the first and second stops maintain the plate in a central position with no or very little play when the boot and plate are in the stable maintenance position.

According to a preferred embodiment, in the maximum open position of each of the wings, the corresponding stop forms an abutment limiting the maximum lateral extent of movement of the anti-friction plate towards such wing. Thus, the stop arm, irrespective of its position, forms a permanent abutment to prevent excessive lateral movement of the anti-friction plate; the position of the abutment in each position is determined by the position of its associated wing.

According to one embodiment, the anti-friction plate is pivotably mounted around a fixed axis. According to another embodiment, the anti-friction plate is guided by transverse guides (rectilinear or arcuate) along either a transverse rectilinear movement or a curvilinear movement.

The FIGS. illustrate a ski binding which is adapted to maintain the front end of boot 1 on a ski. Sole 2 of boot 1 rests on an anti-friction plate 3 positioned on the upper surface 4 of ski 5. Plate 3 is pivotably mounted along its first end 6 around a fixed vertical axis 7, i.e., an axis which is perpendicular to the surface of ski 5. The second end 8 of anti-friction plate 3 thus allows for lateral movement of the plate with respect to the median plane of symmetry II—II of the ski, by rotation around axis 7.

Figure 2:
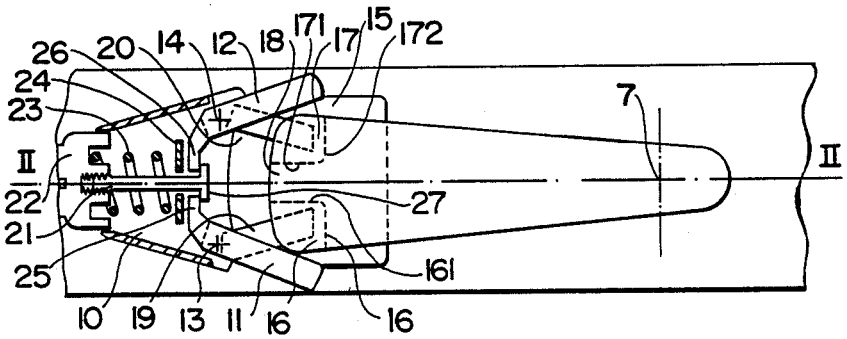
FIG. 2 illustrates, in top view, the binding of FIG. 1 according to the invention, with the boot in a stable maintenance position.

The second end 8 of the anti-friction plate is positioned adjacent to a binding 9, which binding comprises a fixed body 10 provided with a first lateral wing 11 and a second lateral wing 12. In the embodiment shown, wings 11 and 12 are pivotably mounted, respectively, around shafts 13 and 14, which are vertically positioned on fixed body 10, and which are biased by elastic return means, e.g., a suitably positioned spring (not shown), towards a stable maintenance position for the boot, such as is shown in FIG. 2. In this stable maintenance position, boot 1 is maintained laterally by wings 11 and 12, and is substantially positioned along a median vertical plane of the ski.

Fixed body 10 of the binding comprises a base plate, extending in the direction of the zone adapted to be covered by boot 1, forming an anti-friction socket 15 on the upper surface of which rests anti-friction plate 3.

A second end 8 of the anti-friction plate 3 comprises two lower lateral recesses 16 and 17, defined or limited along the interior of the plate by respective longitudinal surfaces 161 and 171, by respective posterior transverse surfaces 162 and 172, and by an upper surface such as surface 63 shown in FIG. 1. Surfaces 161 and 171 define between them a central (forward) portion (or tongue) 18 of the anti-friction plate 3.

The lateral extent of movement of the anti-friction plate 3 is limited on both sides of the vertical median longitudinal plane II—II of the ski by two extent limitors, i.e., stops, which comprise, in the embodiment shown, the ends of a first arm or abutment 19 and of a second arm or abutment 20. The stops 19 and 20 thus form two abutments between which the central portion 18 of the anti-friction plate 3 is adapted to be engaged. The arms 19 and 20 are respectively affixed to wings 11 and 12, such that movement of one wing causes the spacing of the corresponding (attached) arm from the plate, thereby modifying the possible extent of movement of the anti-friction plate 3.

As shown in FIG. 1, the stops such as arm 19 each comprise an arm which engages a lateral lower corresponding cutout or recess 16 in the anti-friction plate 3 (see also FIG. 5). Preferably, arms 19 and 20 each have a sufficient length so as to constitute an abutment for limiting the movement of the anti-friction plate to various desired degrees, dependent upon the angular position of the corresponding wing, including when the wing is in a position of maximum spacing away from the plate.

In the embodiment shown, in the stable maintenance position of the boot, such as is seen in FIG. 2, arms 19 and 20 effectively maintain, without any (or only little) play, the central portion or tongue 18 of the anti-friction plate 3 in a stable position. In this case, they assure complete recentering of the plate under the influence of the elastic return means.

In FIG. 2, the elastic return means comprises a longitudinal spring 23 which, at one of its ends, is supported against an abutment 24 integral with the ski.

At its other end, the spring is biased by a cap 22 screwed into the end of a tension element 21 which is longitudinally movable, the movement of the tension element being controlled by the movement of either one of the wings 11 or 12.

To enable this, the wings 11, 12 are extended beyond their journal axis 13, 14 by respective extensions 25 and 26 which are held within the head 27 of the tension element.

The screwing of the cap makes it possible to adjust the tension of spring 23.

Figure 3:
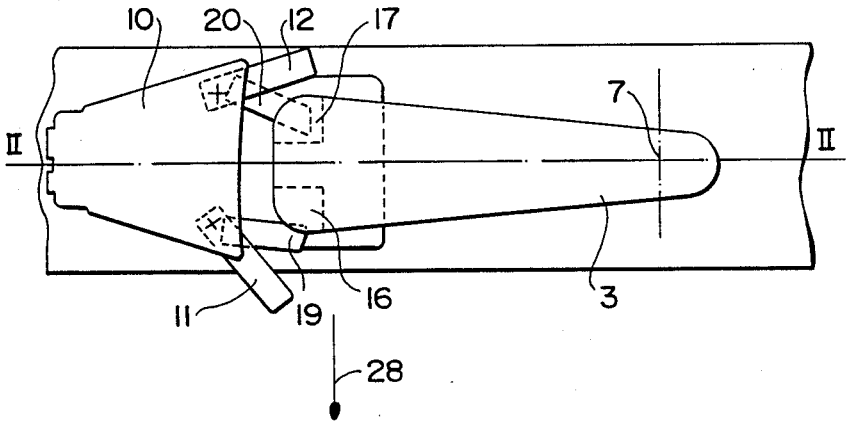
FIG. 3 illustrates, in top view, the binding of FIG. 1 according to the invention in a position in which the left lateral wing has released to free the boot, the anti-friction plate being in the centered position.

The operation of the apparatus is as follows: in normal use, the boot is maintained in its stable, centered equilibrium position, as shown in FIG. 2. When subjected to a substantial force, the boot laterally pushes one of the wings, for example wing 11 as shown in FIG. 3, which tends to bring the binding into a release position in which the end of the boot adjacent the binding is freed, and can laterally escape in the direction shown by arrow 28. During the rotation of wing 11, the return arm 19 pivots towards the exterior of the ski, spacing itself from the other arm 20. Anti-friction plate 3 can then freely pivot around its axis 7 between a first extreme position, as shown in FIG. 3, which is the stable centered position, and a second extreme position, shown in FIG. 4, in which the longitudinal surface 161 of the plate rests against return arm 19. It should be understood that the pivoting of wing 11 does not cause the pivoting of the anti-friction plate 3; instead, the pivoting of wing 11 permits the free pivoting of the anti-friction plate 3. Thus, even if the anti-friction plate 3 is blocked or braked by ice which may develop between the lower plate surface and upper surface 4 of the ski, the pivoting of wing 11 is not hindered by the presence of this ice. The upper surface of the anti-friction plate 3 thus operates as a traditional anti-friction surface on which the boot slides.

In the absence of ice between the anti-friction plate and the ski, the boot rotationally moves the anti-friction plate 3 at the same time as wing 11. The pivoting of the anti-friction plate does not require, with respect to the boot, any supplemental force, because the anti-friction plate is freely pivotable around its axis 7. There is no energy exerted at the level of the plate to hinder release of the binding.

When wing 11 returns to the stable maintenance position, under the action of its elastic biasing means, arm 19 approaches arm 20. If the anti-friction plate 3 has first been displaced, as is shown in FIG. 4, return arm 19 remains in abutment against longitudinal surface 161 of the corresponding plate recess and pushes anti-friction plate 3 back, assuring automatic recentering of the plate.

According to the embodiment shown in FIGS. 1–5, the anti-friction plate is pivotably mounted around a fixed axis 7.

Figure 7:
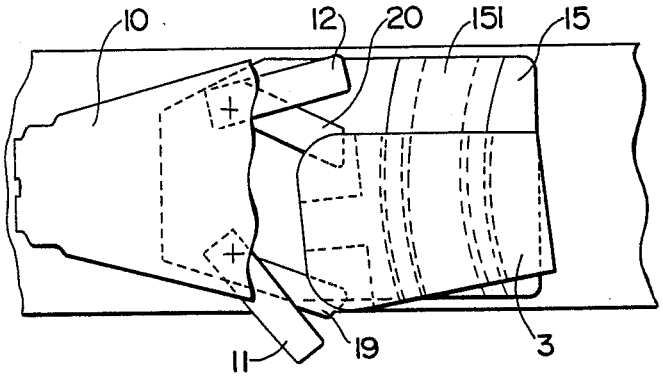
FIG. 7 illustrates, in top view, the binding of FIG. 6 in a laterally offset position.

According to the embodiment shown in FIG. 6 and 7, the anti-friction plate is guided by transverse guides so as to move over a transverse translational path which can be either rectilinear or curvilinear. Such guidance is assured by a transverse upper rib or track 151 of base 15, formed in the shape of a rounded tail which engages itself in a lower transverse groove 31 in the underside of plate 3, the groove having a complementary shape with respect to the tail.

The present invention is not limited to the embodiments which have been described, but extends to all variations and generalizations contained within the claims which follow. In particular, in an evident fashion, the invention can relate to a front binding whose lateral independent wings are rotatably journalled to the ends of connecting rods which are themselves journalled with respect to the fixed body. Such a binding is, for example, described in French Patent No. 2,173,049.

Furthermore, the surfaces which slide against one another, particularly the lower surface of the sole of the boot and the upper surface of the anti-friction plate 3, as well as the lower surface of the plate 3 at the level of its second end 8 and the upper surface of base 15, can be equipped with any intermediate appropriate means adapted to favor and promote relative sliding between surfaces, for example, the plate can be formed from a layer of anti-adhesive material, or from rotating rollers.

Finally, although the invention has, as has been noted above, been described with reference to particular means, materials and embodiments, it should be noted that the invention is not limited to the particulars disclosed, and extends to all equivalents within the scope of the claims.

We claim:

1. A safety binding assembly adapted to be attached to a ski in order to releasably retain a boot on said ski, said binding assembly comprising:

(a) an anti-friction plate adapted to be laterally movably attached to an upper surface of said ski from a normal position to a laterally displaced position, said anti-friction plate comprising means for supporting the sole of said boot when said boot is positioned on said ski;

(b) a binding having a fixed body adapted to be attached to said ski adjacent one end of said plate;

(c) first and second independently movable wings attached to said fixed body, said wings comprising means for laterally retaining one end of said boot adjacent said one plate end;

(d) elastic return means for biasing said first and second independently movable wings into a predetermined stable boot maintenance position, wherein said boot is adapted to be positioned along a substantially longitudinal vertical median plane of said ski when said wings are in said stable maintenance position; and (e) first and second stops connected to respective ones of said first and second independently movable wings, said first and second stops being movable between first respective engaging positions adjacent respective portions of said anti-friction plate and second respective positions laterally removed from said respective positions of said anti-friction plate for permitting said anti-friction plate to remain in said normal position upon movement of said stops, as well as to move toward one of said laterally displaced positions, between said first and second stops.

2. A safety binding assembly in accordance with claim 1, wherein said elastic return means comprise means for biasing said wings towards the median plane of said ski and thereby comprise means for centering said anti-friction plate in said stable boot maintenance position.

3. A safety binding assembly in accordance with claim 1, wherein said first and second stops comprise means for maintaining said plate, when supporting said boot in said stable maintenance position, such that said plate is adapted to have only limited movement on either side of said median plane.

4. A safety binding assembly in accordance with claim 1, wherein said stops comprise first and second movement limiting members having one end attached to a respective one of said wings and a second end comprising an abutment against which a central portion of said anti-friction plate is adapted to abut.

5. A safety binding assembly in accordance with claim 4, wherein each of said wings is integrally attached to respective ones of said stops, and further wherein movement of one of said wings causes an equal displacement of the stop which is attached to said wing towards and away from said longitudinal vertical median plane.

6. A safety binding assembly in accordance with claim 5, wherein said stops are positioned on opposite sides of said central plane of said anti-friction plate.

7. A safety binding assembly in accordance with claim 6, wherein each of said wings is pivotable over a predetermined maximum displacement, with respective stops being pivotable with said wings and thereby comprising means for variably defining the limit of the lateral extent of movement of said anti-friction plate away from said median plane.

8. A safety binding assembly in accordance with claim 1, wherein said anti-friction plate includes first and second recesses on a lower surface of said anti-friction plate, respective stops being adapted to be positioned in respective recesses of said plate.

9. A safety binding assembly in accordance with claim 1, wherein said anti-friction plate is adapted to be freely and pivotably mounted about a substantially vertical axis with respect to said ski.

10. A safety binding assembly in accordance with claim 1 wherein said binding body includes a track comprising means for guiding lateral movement of said plate, said plate having a lower surface with a continuous groove for receiving said track.

11. A safety ski assembly adapted to be attached to a ski, said assembly comprising:

(a) a plate adapted to be attached to the upper surface of said ski for lateral movement between a normal position and a laterally displaced position, said plate having first and second ends;

(b) a binding adapted to be attached to the upper surface of said ski, said binding having two wings mounted for independent movement relative to each other, and means for biasing said wings into a stable position; and (c) means for limiting the extent of lateral movement of said plate connected to said independently movable wings and comprising means mounted for movement between positions adjacent said plate and laterally removed from said plate for permitting said plate to remain in said normal position upon movement of said limiting means to said laterally removed position as well as to move toward a laterally displaced position.

12. A safety ski assembly in accordance with claim 11, wherein a first end of said movable plate is pivotably mounted to said ski about a fixed vertical axis.

13. A safety ski assembly in accordance with claim 11 wherein said movable plate provides a movable support surface which is adapted to move a ski boot when a boot is positioned on said plate.

14. A safety ski assembly in accordance with claim 11, wherein one end of said movable plate is positioned for movement over a portion of said binding, said one plate end being laterally movable between said extent limiting means.

15. A safety ski assembly in accordance with claim 11, wherein said movable plate has an upper surface, an underside, a length, and a width, wherein a groove is located on said underside, said groove being positioned substantially transverse to said length of said plate.

16. A safety ski assembly in accordance with claim 15 wherein said binding includes an upwardly directed rib comprising a track on which said groove is slidably positioned.

17. A safety ski assembly in accordance with claim 16, wherein said rib and groove are both substantially arcuate in configuration.

18. A safety ski assembly in accordance with claim 16, wherein said rib and groove are both substantially linear in configuration.

19. A safety ski assembly in accordance with claim 11, wherein the extent of said lateral plate movement is limited along both sides of a median plane of symmetry of the ski.

20. A safety ski assembly in accordance with claim 11, wherein one end of said movable plate comprises two lateral recesses on an underside of said plate, said recesses being separated by a central tongue.

21. A safety ski assembly in accordance with claim 20, wherein said extent limiting means comprise stop arms attached to said movable wings, said stop arms being adapted to fit within said plate recesses and abut said plate tongue to limit movement of said plate.

22. A safety ski assembly in accordance with claim 11, wherein said binding comprises a body which includes a stationary base and said two laterally movable wings.

23. A safety ski assembly in accordance with claim 22, wherein said base is adapted to extend in the direction of the longitudinal axis of said ski, said base comprising a platform on which said movable plate rests when said plate is stably maintained along a median longitudinal plane of said ski.

24. A safety ski assembly in accordance with claim 22 wherein said wings are independently pivoted to said binding body.

25. A safety ski assembly in accordance with claim 24 wherein one end of each of said movable wings is pivotably connected to said binding.

26. A safety ski assembly in accordance with claim 11 wherein said independently movable wings are biased into a stable position in which one end of a ski boot adapted to be positioned on said plate is maintained in a stable position by said extent limiting means.

27. A safety ski assembly in accordance with claim 26, wherein said extent limiting means comprises stop arms, said stable boot position occurring when said arms abut one end of said plate when said plate is positioned in said stable maintenance position.

28. A safety ski assembly in accordance with claim 11 wherein said movable wings are biased by elastic return means to automatically return said wings to said stable wing position.

29. A safety ski assembly in accordance with claim 11, wherein each of said wings is biased into a stable position by at least one elastic return means.

30. A safety ski assembly in accordance with claim 29, wherein said wings are adapted to be displaced from their said stable position by application of a predetermined force exerted by a ski boot.

31. A safety ski assembly in accordance with claim 11, wherein said extent limiting means comprise stop arms, each said arms being attached to one of said movable wings.

32. A safety ski assembly in accordance with claim 31, wherein each said stop arm is integrally connected to one movable wing, wherein each wing and connected arm are pivoted simultaneously when one end of a ski boot moves laterally, abuts a wing and moves the abutted wing outwardly from said ski.

33. A safety ski assembly in accordance with claim 32, further comprising elastic return means for returning said wings to a stable wing position when said wings have moved outwardly away from said ski.

34. A safety ski assembly in accordance with claim 11, wherein said biasing means comprise means for biasing said wings into a stable position when said wings have moved outwardly away from said ski.

35. A safety ski assembly in accordance with claim 11, in combination with said ski, wherein said plate and said binding are mounted on said ski.

36. A safety binding assembly comprising:

(a) an anti-friction plate movable between a centered position and either of two opposite lateral positions;

(b) a binding comprising:

(i) a fixed body;

(ii) a first wing movable relative to said fixed body between a retention position and a release position; and (iii) a second wing movable relative to said fixed body and movable relative to said first wing between a retention position and a release position; and (c) means connected to said first wing and said second wing for limiting lateral movement of said plate, said means for limiting lateral movement of said plate being mounted for movement between positions adjacent said plate and laterally removed from said plate for permitting said plate to remain in said centered position upon movement of said means for limiting lateral movement to said laterally removed position, as well as to move toward one of said two opposite lateral positions.

37. The safety binding assembly of claim 36 wherein said means responsive to the positions of said first wing and said second wing comprises means responsive to the position of said first wing for limiting lateral movement of said plate in a first lateral direction and means responsive to the position of said second wing for limiting lateral movement of said plate in a second lateral direction.

38. The safety binding assembly of claim 37 wherein said means for limiting lateral movement of said plate in a first lateral direction comprises an element attached to said first wing, wherein said means for limiting movement of said plate in a second lateral direction comprises an element attached to said second wing, and a portion of said plate is positioned between said elements in said centered position.

39. The safety binding assembly of claim 36 wherein said plate comprises a first abutting surface and a second abutting surface, wherein said means responsive to the positions of said first wing and said second wing comprises means fixed for movement, respectively, with said first means and said second means and spaced from said first abutting surface and said second abutting surface, respectively, in said centered position of said plate.

40. A safety binding assembly for attachment to a ski in order to releasably retain a boot on said ski, said binding assembly comprising:

(a) an anti-friction plate for laterally movably supporting the sole of said boot on said ski between laterally displaced positions, between which is a normal position;

(b) a binding having a fixed body for attachment to said ski proximate an end of said plate, said binding including first and second independently movable wings attached thereto, said wings comprising means for laterally retaining an end of said boot adjacent said end of said plate, each of said wings being biased into a predetermined boot maintenance position against lateral movement therefrom by elastic return means, wherein said boot is positioned along a substantially longitudinal vertical median plane when said wings are in said predetermined boot maintenance position; and (c) first and second stops connected to and movable in response to movement of respective ones of said first and second independently movable wings, said first and second stops being movable between first respective engaging positions adjacent respective portions of said anti-friction plate and second respective positions laterally removed from said respective positions of said anti-friction plate for permitting said anti-friction plate to remain in said normal position upon movement of said stops, as well as to move toward one of said laterally displaced positions, between said first and second stops.

41. A safety ski assembly for attachment to a ski, said assembly comprising:

(a) a plate for attachment to an upper surface of said ski and for being laterally movable relative thereto from a normal position to a laterally displaced position;

(b) a binding for attachment to said upper surface of said ski, said binding comprising independently movable first and second wings, and means for biasing said first and second wings into a stable boot retention position; and (c) means connected to said independently movable wings for limiting lateral movement of said plate to an amount determined by respective positions of said first and second wings, said means for limiting lateral movement of said plate being mounted for movement between positions adjacent said plate and laterally removed from said plate for permitting said plate to remain in said normal position upon movement of said means for limiting lateral movement to said laterally removed position, as well as to move toward a laterally displaced position.

* * * * *